United States Patent [19]

Swenson

[11] Patent Number: 4,794,993

[45] Date of Patent: Jan. 3, 1989

[54] MANUAL TORQUE MAGNIFYING IMPACT TOOL

[76] Inventor: Oscar Swenson, 7315 E. Wikieup, Tucson, Ariz. 85715

[21] Appl. No.: 188,044

[22] Filed: Apr. 29, 1988

[51] Int. Cl.[4] ..... B25D 15/02

[52] U.S. Cl. ..... 173/93.5; 81/466

[58] Field of Search ..... 173/93, 93.5, 93.6, 173/93.7; 81/465, 466, 60, 61, 177.9

[56] References Cited

U.S. PATENT DOCUMENTS

| | | | |
|---|---|---|---|
| 3,180,185 | 4/1965 | Schmidt et al. | 173/93 |
| 3,184,998 | 5/1965 | Young | 173/93.5 |
| 4,184,552 | 1/1980 | Anderson | 173/93.5 |
| 4,293,044 | 10/1981 | Anderson | 173/93.5 |

*Primary Examiner*—Frank T. Yost
*Assistant Examiner*—James L. Wolfe
*Attorney, Agent, or Firm*—Mark E. Ogram

[57] ABSTRACT

A manually actuated torque magnifying impact tool in which an annular inertia member surrounds and is directly supported rotationally on a common axis on a ratchet tool head. This construction confines impact stresses to the inertia member and tool head, instead of carrying these stresses through bearings and frame members as in former constructions, which required extra studiness in these members and thus undesirable extra weight in the tool.

12 Claims, 1 Drawing Sheet

MANUAL TORQUE MAGNIFYING IMPACT TOOL

BACKGROUND

This invention relates generally to manually actuated torue magnifying wrenches and more particularly to the bearing supports for the inertia member of these wrenches.

Manually actuated torque magnifying wrenches permit the user to store energy in a spring which is released to provide a momentary torque far in excess of what the human operator could have achieved with a standard wrench of the same dimensions.

Several patents have been issued on manually actuated impact tools for applying a torsional force, greater than applied to the tool at the moment of torsional force application. This includes U.S. Pat. Nos. 2,661,647; 2,884,982; 2,954,714; 3,108,506; 3,156,309, 4,382,476; and 4,418,768.

In each of these patents, the operation of the device illustrates a manually operable impact tool. Each device generally contains a manually operable handle, a power spring for the momentary storage of energy, and an annular inertia member carrying pawls which engage a ratchet-toothed member. The ratchet-toothed member is connected to the output shaft which is connectable to a socket or other mechanism to engage a threaded fastener such as a nut or bolt.

Energy derived from the movement of the handle is stored in and is released by the power spring. At the moment of release, the annular inertia member forces its pawls into the ratchet-toothed member to cause the ratchet-toothed member to rotate, thereby either rotating or attempting to rotate the output shaft to either loosen or tighten the threaded fastener.

In this manner, the operator is able to store up energy in the power spring for later momentary application. This results in a force being applied to the threaded fastener which is far in excess of that which could be applied by the same dimensional wrench by the same operator.

Although the tools of the above patents have proven superior in performance to traditional tools, the energy which is released from the power spring has caused problems which heretofore were corrected by the addition of strengthening material which in turn creates a tool which is heavier and less desirable to use.

Specifically, with regards to the tools of U.S. Pat. Nos. 4,382,476, and 4,418,768, the inertia member is maintained in position through the use of a bearing being extended from the frame member. The frame members therefore must be able to withstand the shock of the power when the power spring releases, necessitating undesirable increase in their weight to withstand this shock.

Additionally, in the construction of these tools, the annular inertia member is supported between the frame members by a bearing surface at the inner surface of the annular inertia member mating with a bearing surface attached to each frame member. Because of this design, the diameter of these bearing surfaces is relatively large with respect to the overall diameter of the inertia member. Since loss of torque output from the tool due to friction in these bearing surfaces is proportional to their diameter, these tools have an inordinate amount of friction energy loss.

As with all hand tools, the weight of the tool is critical and must be maintained so that the operator can use it in hard to reach places and can readily transport it from the field vehicle to the work location.

SUMMARY OF THE INVENTION

It is clear from the foregoing discussion that it is imperative that the manual torque magnifying wrench be sturdy enough to withstand the large amount of energy which is stored and released and yet be as light as possible.

This invention relates to the general structure disclosed in U.S. Pat. Nos. 4,382,476, and 4,418,768, both of which are incorporated herein by reference.

In the present invention, the support of the annular inertia member is supplied by segmented bearing surfaces within and integral with the annular inertia member which contact the peripheral surfaces of the toothed ratchet, which in turn is supported by the frame members of the tool. This construction provides better support for the inertia member than in former constructions, eliminating the need for reinforcement of the frame members, thus resulting in a lighter and more desirable tool.

The bearing material is chosen so that it is not as hard as the ratchet-toothed member which precludes gauling of the bearing surface.

The invention, together with various embodiments thereof will be more fully explained by the following drawings and their accompanying descriptions.

DRAWINGS IN BRIEF

DRAWINGS IN DETAIL

Figure 1:
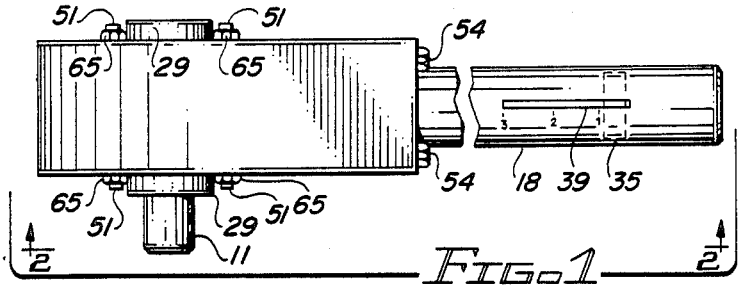
FIG. 1 is a plan view illustrating a manually operated torque magnifying impact tool constituting the best mode contemplated for the practice of the invention.
Figure 2:
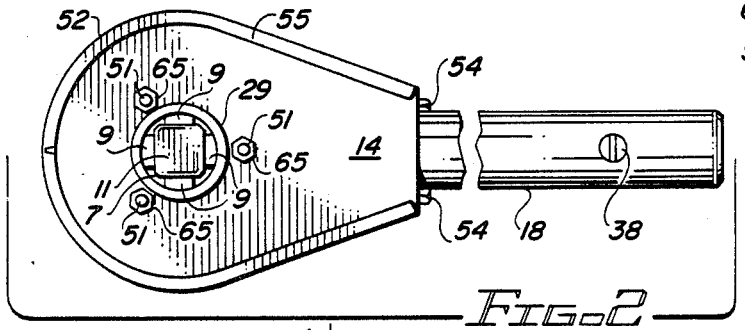
FIG. 2 is a side view of the tool illustrated initially in FIG. 1.
Figure 4:
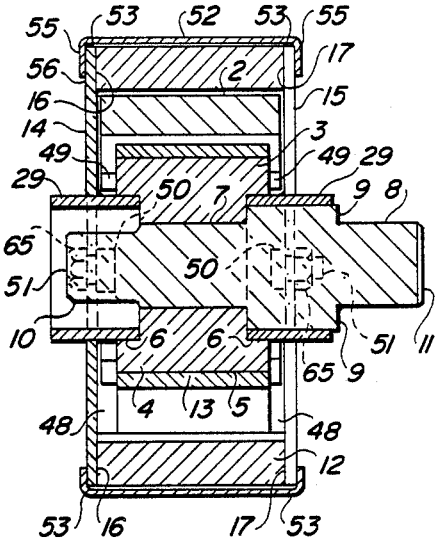
FIG. 4 is a cross sectional view taken along line 4—4 of FIG. 3.
Figure 3:
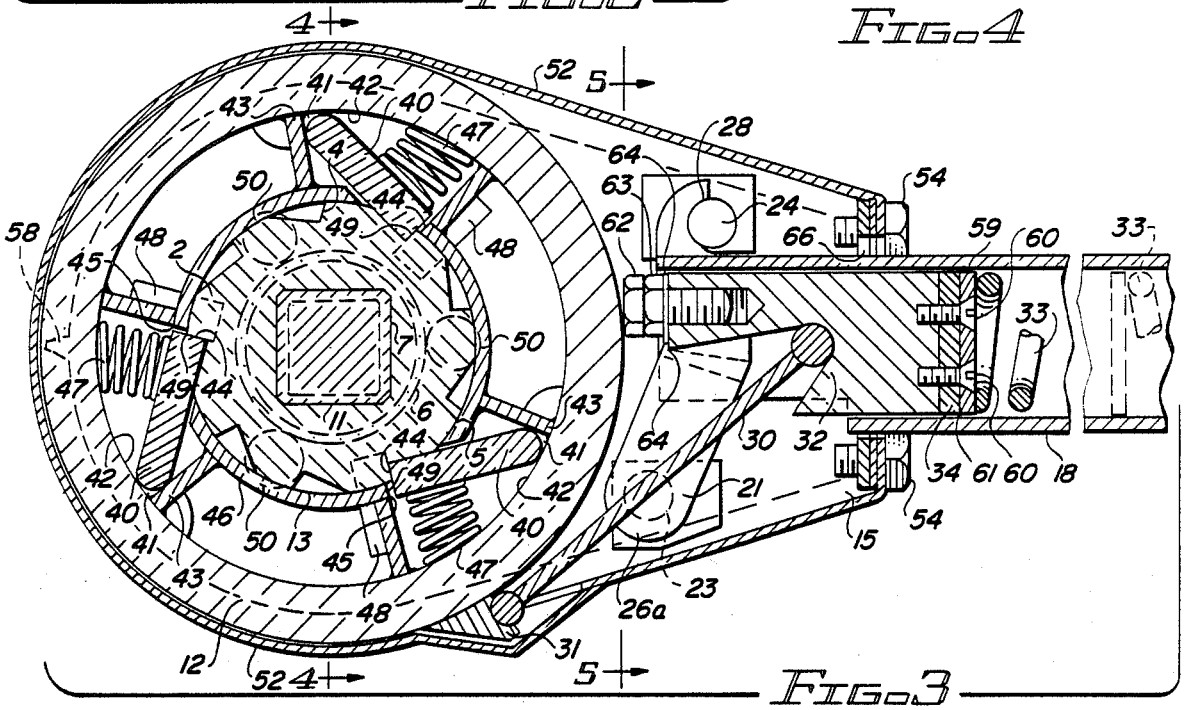
FIG. 3 is a cross sectional view taken parallel to line 2—2 of FIG. 1 at the center of handle 18.
Figure 5:
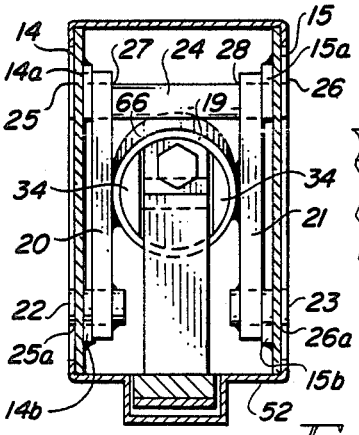
FIG. 5 is a cross sectional view taking along line 5—5 of FIG. 3.
Figure 6:
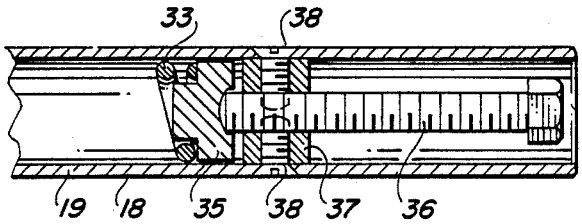
FIG. 6 is a section view through the handle 18.

FIG. 1 through 5 illustrate the preferred mode of the invention. This embodiment of the invention conforms to the basic organization of U.S. Pats. Nos. 4,382,476, and 4,418,768.

The tool or tool assembly of this invention comprises essentially:

(a) a tool head 2 consisting of a cylindrical ratchet portion 3 having peripheral, parallel and equally spaced ratchet teeth 4, cylindrical bearing surface 5, consisting of the outer peripheral surface of said ratchet teeth 4, a circular bearing surface 6 at each end of said ratchet portion on a common axis therewith and with said bearing surface 5, and a square axial opening 7 between said circular bearing surfaces;

(b) a square drive bar 8 of uniform square dimension longitudinally only sufficiently less than that of square opening 7 to enable insertion of either end of said bar freely into said opening from either side of the tool, stops 9 attached to said bar intermediate the ends thereof to limit the distance of said insertion and to provide, in combination with the length of said bar, for extension thereof a desirable distance outside the tool on the side of said insertion, and a square portion 10 of square dimension less than that of said bar, integral therewith, and extending beyond the end of said bar opposite opposite end 11 thereof;

(c) an annular inertia member 12 surrounding the ratchet portion 3 on a common axis therewith, bearing surface 13 within and integral with said annular inertia member engaging said bearing surface 5 of said ratchet portion to enable angular rotation of said inertia member and said ratchet portion relative to each other about a common axis, frame member 14 with boss members 14*a* and 14*b* welded thereto and frame member 15 with boss members 15*a* and 15*b* welded thereto, all transverse the said axis at each end 16 and 17 of said inertial member, respectively;

(d) a handle assembly 18, consisting of a tube member 19 attached at one end to flange 20 and flange 21, said tube member supported to extend perpendicularly to the axis of said inertia member 12 by pins 22 and 23 seated in holes 25*a* and 26*a* in frame members 14 and 15 respectively, and by pin 24 seated in holes 25 and 26 in frame members 14 and 15, respectively, to engage surface 27 and 28 of flange 20 and 21, respectively, to provide for angular movement of handle assembly 18 by pivoting on pins 22 and 23 in the direction opposite to the direction causing impacts to be delivered by the tool, with an opening 66 provided in frames 14 and 15 to permit said movement of handle assembly 18 with respect to said frame members, and to provide for restriction of said angular movement of said handle assembly, in the direction for delivery of impacts by the tool, by contact of surface 27 and surface 28 with pin 24;

(e) bearing members 29 attached to each of frame members 14 and 15, respectively, mating with bearing surface 6 on ratchet portion 3, for guiding ratchet portion 3, and frame members 14 and 15 in unison with handle assembly 18, for angular rotation relative to each other about said axis;

(f) the combination of a pitman 30 pivotally seated at one end in bearing 31 attached to the outer surface of inertia member 12, and seated pivotally at the opposite end in a cross head 32 operating reciprocally and longitudinally within tube member 19, said combination operatingly connecting inertia member 12 to a power compression spring 33 in tube member 19 between stop members 34, attached to tube member 19, and thrust member 35, to enable storing energy in and releasing energy from spring 33 on angular movement of handle 18 relative to inertia member 12, and on angular movement of inertia member 12 relative to handle 18, respectively;

(g) a spring adjusting screw 36 operating in nut 37 attached to tube member 19 by screws 38, and slot 39 in tube member 19 for viewing the position of thrust member 35 to enable adjustment of initial compression of power spring 33 to any desired value within the limits therefore;

(h) bearing member 46 attached to inertia member 12, mating with bearing surface 5 on ratchet portion 3 on a common axis therewith;

(i) one or more pawls 40 with an end pivotally seated in seat 41 formed by inner surface 42 of inertia member 12 and abutment 43 attached thereto, and opposite end 44 of said pawl operable freely, while pivoting in seat 41, against edge 45 of bearing member 46, and biased by spring 47 for engagement with and disengagement from ratchet teeth 4;

(j) stop members 48 on frame members 14 and 15 cooperating with pawl ends 49 to limit angular rotation of inertia member 12 relative to handle 18 in one direction about said axis;

(k) a cam surface 50, one for each pawl 40, depicted in the respective figures herein as being provided by the heads of cap screws 51, as one optional means, but not limited thereto, attached to frame members 14 and 15 by nuts 65 on said cap screws, said cam surfaces operable against pawls 40 on angular movement of handle 18 about said axis, relative to inertia member 12 and ratchet 3, in a predetermined direction, to enable disengagement of pawls 40 from ratchet teeth 4, subsequent to rotation of inertia member 12 about said axis in said predetermined direction relative to ratchet member 3, and re-engagement of pawls 40 with the respective successive ratchet 4 to impart thereto energy released from spring 33;

(l) a cover member 52, engaging edges 53 of frame members 14 and 15 enclosing the space between said frame members and attached thereto by cap screws 54; flange edges 55 of said cover member engaging the outer surfaces 56 and 57 of said frame members, respectively, to hold said frame members in position relative to ends 16 and 17 of inertia member 12, respectively, and notches 58 in flange edges 55 of cover member 52 to provide flexibility thereto to enable installation and removal of said cover member to and from said tool;

(m) the combination of pressure plate 59 attached to crosshead 32 by screws 60 with shims 61 therebetween, and bolt 62 attached to crosshead 32 with locknut 63 and shims 64 therebetween, provides for adjustment of operating clearance for pitman 30 between crosshead 32 and inertia member 12, and for adjustment of operating clearance between bolt 62 and inertia member 12, respectively.

In accordance with the previous description, assuming that the drive bar 8 is held rotationally immobile by being suitably connected, as with a commonly used socket, to a threaded fastener being serviced by the tool, and in turn ratchet 3 also being held rotationally immobile by engagement with said drive bar, it is apparent that continuous angular movement of handle 18 in a direction about said axis relative to ratchet 3 and inertia member 12, so as to cause pawl end surfaces 44 to act against ratchet teeth 4, will result in successive cycles of disengagement of pawls 40 from ratchet teeth 4 by the cam surface 50, and re-engagement of the pawls 40 with ratchet teeth 4 with impatct force to produce torque on the ratchet 3 and drive bar 8, and therefrom to the fastener being serviced by the tool, the magnitude of said torque being greater than that of the torque applied to the handle of the tool by the operator. It is also apparent that the handle 18 of the tool can be moved through an arc in an angular reciprocating movement to deliver one or more of said impacts per cycle of said reciprocating angular movements, at the discretion of the operator of the tool.

In the tool constructed with a ratchet 3 with nine teeth spaced equally at intervals of 40 degrees around the circumference of said ratchet as depicted in the figures, angular movement of handle 18 about the axis of said ratchet in the direction to cause pawls 40 to act against ratchet teeth 3 results in disengagement from and re-engagement with ratchet teeth 4 at intervals of angular movement of said handle of 40 degrees plus the degrees of angular movement of the threaded fastener engaged by the tool as a result of the immediately preceding impact applied thereto by the tool.

To provide for a practical degree of movement of said threaded fastener as a result of application of a single impact thereto by the tool without resulting in the rotation of the rotor being stopped by contact of pawl ends 49 with stops 48 on frame members 14 and 15, cam surfaces 50 are located with respect to the pawls 40 to provide for an angular movement of said fastener of about five degrees before contact of said pawl ends with stops 48, as a result of a single impact.

If with a single impact, this five degree angular movement of said fastener is achieved before all of the energy stored in inertia member 12 is expended against the fastener, the residual energy in the inertia member is expended by contact of pawl ends 49 against stops 48 attached to frame members 14 and 15. Since the inertia inherent in handle 18 renders it partially immobile, the force on frame members 14 and 15 imparted by pawl ends 49 against stops 48 will result in said frames pivoting on pins 22 and 23, causing bolt 62 to contact inertia member 12, in turn causing partial compression of spring 33 through crosshead 33.

Thus said spring acts as a shock absorber to absorb energy from the inertia member not absorbed by said fastener, thereby reducing the stress on tool parts otherwise required to absorb said residual energy.

Clearance for angular movement of handle 18 when frames 14 and 15 are pivoting on pins 22 and 23 in one directions is provided by opening 66 in said frame members.

IMPROVED INERTIA MEMBER BEARINGS

In the construction U.S. Pat. Nos. 4,382,476 and 4,418,768, an annular inertia member is supported between frame members by a bearing surface at the inner surface of the annular inertia member mating with a bearing surface attached to each frame member. Thus the diameter of these bearing surfaces is relatively large with respect to the overall diameter of the inertia member. Since loss of torque output from the tool from friction in these bearing surfaces is proportional to their diameter, smaller diameter bearing surfaces would be desirable to reduce torque output loss due to friction.

The construction of this invention reduces the diameter of the bearing surfaces supporting the inertia member, and thus the loss of torque output from the tool by friction at these surfaces by providing bearing surfaces within and attached to the inner surface of the annular inertia member which engage bearing surfaces on the ratchet member, consisting of the cylindrical peripheral surfaces of the ratchet teeth, thus substantially reducing the diameter of these bearing surfaces over that of the previously mentioned patents with a proportionate reduction in loss of torque output from the tool by friction at these bearing surfaces.

The improved inertia bearing construction of this invention has a further advantage over that of the prior patents in that any stress on tool parts resulting from shock on impact of the pawls against the teeth of the ratchet member or against the inertia member stops is condfined to the combination of the inertia member, pawls, and ratchet and is not carried to the frame members and other tool parts through the inertia member bearings attached to the frame members as in the construction of the tool of previous patents.

ELIMINATION OF INTERMEDIATE INERTIA MEMBER BEARING

The need for the intermediate inertia member bearing of the U.S. Pat. No. 4,418,768 is eliminated in this invention as an additional advantage because the ratchet teeth, used as the bearing surface for the ratchet, are best constructed of hardened alloy steel, and the mating inertia bearing surfaces are preferably constructed of mild steel, thus precluding a tendency to gaul, which was the purpose of the prior intermediate bearing.

ELIMINATION OF NOTCHES AT ENDS OF PAWLS

Elimination in the construction of this invention of of the inertia member bearing in the construction of this above U.S. Pat. No. 4,418,768, also eliminates the need for cutting notches at the ends of the pawls to clear said bearing, thus contributing to a reduction in the cost of production of the tool.

PROVISION OF COVER MEMBER FOR ENCLOSING TOOL FOR POSITIONING AND PROTECTING TOOL PARTS AND TO FACILITATE ASSEMBLY AND DISASSEMBLY OF THE TOOL

The construction of this invention includes a cover member surrounding the inertia member and enclosing the space between the frame members, thus protecting the tool parts between the frame members from damage from dirt or other hazards. The cover member also serves to hold the frame members, inertia member, and handle assembly in proper positional relationship, as well as to enable easy assembly and disassembly of the tool.

As is apparent from the foregoing description, the provision for supporting the inertia member directly on the ratchet member for bearing surfaces on the inertia member mating with bearing surfaces on the ratchet member consisting of the cylindrical peripheral surfaces of the ratchet teeth is an important improved construction of this invention contributing to increased efficiency in performance of the tool, and the resultant combination of the inertia member, pawls, and ratchet member, which are the principal functionally related parts of the tool, into a simple compact unit, is an important improvement contributing to reduction in cost of production and increased durability of the tool.

What is claimed is:

1. A manually operable torque magnifying impact tool comprising: a rotary toolhead, an annular inertia member surrounding said tool head, bearing means for supporting said inertia member direct on said tool head for relative angular rotation therewith on a common axis, a frame member transverse to said axis at opposite ends of said inertia member, a torque handle extending transversely of said said axis and connected to said frame member, bearing means coaxial with said axis and attached to said frame member guiding said tool head, said inertia member, said frame member and handle adapted for relative angular movement about said axis, an elongated power spring within said handle, coupling means between said inertia member and said power spring for storing and releasing energy, said tool head including a cylindrical portion having a series of circumferentially equally spaced elongated ratchet teeth around its cylindrical surface parallel to said axis, a pawl pivotally seated at one edge in a seat on said inertia member, said pawl biased by spring means for engagement of the unseated edge thereof with said ratchet teeth, cam means rigid with said frame member around said axis operationally contacting said pawl for its disengagement from and reengagement with said ratchet teeth to impart torque producing impact to said tool head on movement of said handle angularly in a predetermined direction about said axis relative to said tool head, a stop member on said member at times contacted forcibly by said unseated edge of said pawl following said disengagement of said pawl to stop rotation of said inertia member, a pivotal connection between said handle and said frame member to allow limited angular movement of said handle in one direction about said pivotal connection relative to said frame member about an axis parallel to axis of said inertia member and remote from the longitudinal axis of said handle, said coupling means between said inertia member and said power spring including a spring stop member on said handle to limit decompressive movement of said power spring and including a pitman acting pivotally on said inertial member near the peripheral surface thereof and connected pivotally to a crosshead member in contact with said power spring, the combination of said pitman, said spring stop, and said crosshead member providing for compression and decompression of said power spring on said movement of said handle about said axis relative to said tool head in said predetermined direction, for interaction between said crosshead member and said handle on movement of the handle about said axis relative to said tool head in the direction opposite to the said predetermined direction to preclude forcible contact of said unseated end of said pawl with said stop on said frame, and for said interaction responsive to said pivotal movement of the handle relative to said frame member following forcible engagement of said unseated edge of said pawl with said stop on said frame member to compress said power spring to stop rotation of said inertia member by absorbing kinetic energy of rotation therefrom.

2. The tool as claimed in claim 1 wherein said bearing means for supporting said inertia member on said tool head consist of a bearing surface within and integral with said inertia member mating with a bearing surface on said tool head formed by the peripheral cylindrical surface of the ratchet teeth of said tool head.

3. The tool as claimed in claim 2 wherein said bearing surface with and integral with said inertia member surrounds said tool head with a circumferential interruption in said bearing surface to enable passage therethrough of the end of said pawl opposite the end seated in said inertia member for engagement with said ratchet teeth of said tool head.

4. The tool as claimed in claim 3 wherein circumferential interruption in said bearing surface provides means for retaining said pawl seated and opeable pivotally within said inertia member, and also provides, in combination with the inner surface of said inertia member, a chamber for holding in operable position said spring means for pressing said pawl resiliently against said tool head.

5. A torque wrench comprising:

(A) an inertia member;

(B) a toothed ratchet having a plurality of teeth on the circumference thereof;

(C) at least one pawl for imparting energy from the inertia member to the toothed ratchet; and, (D) bearing surface connected to said inertia member and supporting said toothed ratchet by pressure applied against the teeth of said toothed ratchet.

6. The torque wrench according to claim 5 wherein said bearing surface has passages therein to permit said at least one pawl passage therethrough for contact with said toothed ratchet.

7. The torque wrench according to claim 6 further comprising facing members connecting said inertia member and an edge of the passage of said bearing surface and wherein the facing member provides seating for said at least one pawl when said at least one pawl is not engaged with said toothed ratchet.

8. The torque wrench according to claim 5 wherein said toothed ratchet is constructed of material harder than said bearing surface.

9. A tool for applying a torque to a fastener comprising:

(A) means for storage of manually supplied energy;

(B) an inertia member for selective application of said manually supplied energy from said means for storage;

(C) a toothed ratchet having a plurality of teeth on the circumference thereof;

(D) coupling means for selectively attaching the toothed ratchet to said fastener;

(E) at least one pawl for imparting energy from the inertia member to the toothed ratchet; and, (F) a bearing surface connected to said inertia member and supporting said toothed ratchet by pressure applied against the teeth of said toothed ratchet.

10. The tool according to claim 9 wherein said bearing surface has passages therein to permit said at least one pawl passage therethrough for contact with said toothed ratchet.

11. The torque wrench according to claim 10 further comprising facing members connecting said inertia member and an edge of the passage of said bearing surface and wherein the facing member provides seating for said at least one pawl when said at least one pawl is not engaged with said toothed ratchet.

12. The torque wrench according to claim 9 wherein said toothed ratchet is constructed of material harder than said bearing surface.

* * * * *